United States Patent [19]

Baumann

[11] Patent Number: 4,965,695

[45] Date of Patent: Oct. 23, 1990

[54] PERMANENT MAGNETIC RETAINING DEVICE TO MOVE, AFFIX OR CARRY FERROMAGNETIC PARTS OR LOADS WITH ELECTRONIC SWITCHING OF THE MAGNETIC FLUX TO RELEASE THE CARRIED LOAD

[76] Inventor: Joseph D. Baumann, Rua Indore, 14, Sao Paulo, Brazil

[21] Appl. No.: 197,046

[22] Filed: May 20, 1988

[30] Foreign Application Priority Data

May 22, 1987 [BR] Brazil ..... 8702929

[51] Int. Cl.[5] ..... H01F 7/04

[52] U.S. Cl. ..... 361/142; 361/144; 361/147; 335/290; 335/291; 335/294; 340/666

[58] Field of Search ..... 361/139, 142, 143, 144, 361/145, 147, 152, 157, 159; 335/289, 290, 291, 295, 292, 294, 302; 340/666, 685, 825.06, 636; 341/176; 307/119

[56] References Cited

U.S. PATENT DOCUMENTS

| | | | |
|---|---|---|---|
| 1,335,119 | 3/1920 | Louis | 335/302 |
| 3,316,514 | 4/1967 | Radus et al. | 335/291 |
| 3,389,356 | 6/1968 | Schneider | 335/289 |
| 3,798,581 | 3/1974 | Anderson et al. | 335/291 |
| 4,112,750 | 9/1978 | Murakami | 73/141 AB |
| 4,542,361 | 9/1985 | Cavanagh | 335/230 |
| 4,633,361 | 12/1986 | Ela et al. | 361/145 |

*Primary Examiner*—A. D. Pellinen
*Assistant Examiner*—David Osborn
*Attorney, Agent, or Firm*—Steinberg & Raskin

[57] ABSTRACT

Permanent magnetic retaining device to move, affix or carry ferromagnetic parts or load with electronic switching of the magnetic flux to release the carried load includes a central iron core enclosed by a pair of magnet blocks secured by iron shoes, laterally joined to reinforcing plates and terminated by lateral poles with one or more compensator coils being disposed on the central core, with a sliding cover above the former, moving on a pair of guide pins surrounded by mechanical force gauges, the cover being centrally provided with a lifter eyelet. An electronic control circuit is incorporated externally in one of the side walls of a rectangular enveloping overcover wherein, at the opposite side thereof, a sensor of the electronic circuit is incorporated, to be operated manually and/or by remote control.

5 Claims, 13 Drawing Sheets

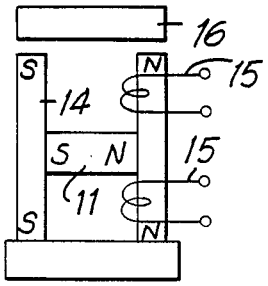
FIG.17
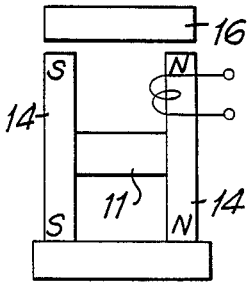
FIG.17a
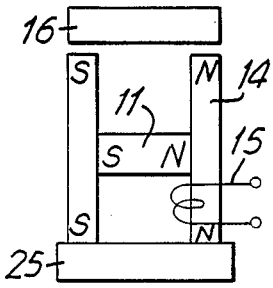
FIG.17b
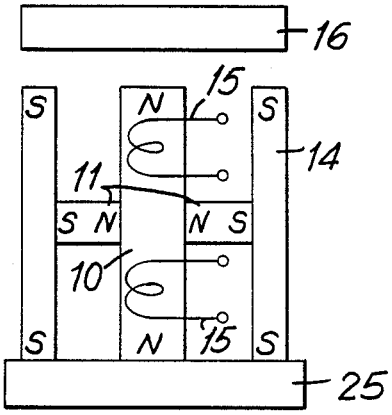
FIG.18
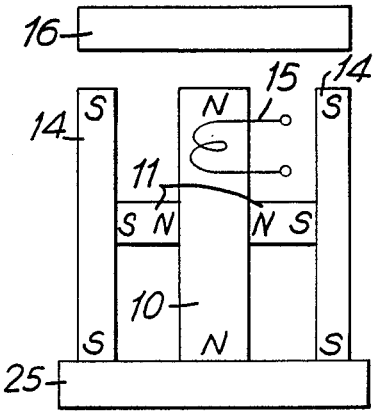
FIG.18a
FIG.18b
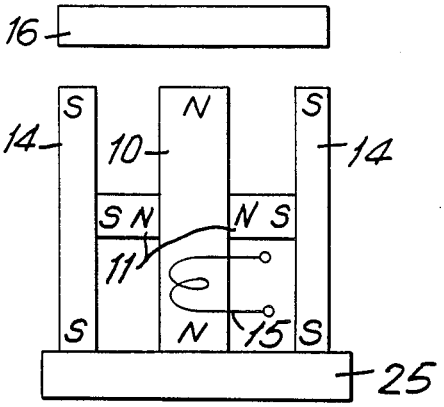

| | TOTAL NUMBER OF POLES | | | | | | |
|---|---|---|---|---|---|---|---|
| | 2 | 3 | 5 | 7 | 9 | 11 | n |
| PERMANENT MAGNET BLOCKS | 1 | 2 | 4 | 6 | 8 | 10 | n-1 |
| COVER SIDE + LOAD SIDE COILS (COIL SELECTION) | 2 | 2 | 4 | 6 | 8 | 10 | n-1 |
| COVER SIDE COILS (COIL REVERSION) | 1 | 1 | 2 | 3 | 4 | 5 | $\frac{n-1}{2}$ |
| LOAD SIDE COILS (COIL REVERSION) | 1 | 1 | 2 | 3 | 4 | 5 | $\frac{n-1}{2}$ |
| MAX. BREAKING WEIGHT (TONS APPROX) | 1 | 2 | 5 | 10 | 20 | 50 | >50 |

FIG. 20

PERMANENT MAGNETIC RETAINING DEVICE TO MOVE, AFFIX OR CARRY FERROMAGNETIC PARTS OR LOADS WITH ELECTRONIC SWITCHING OF THE MAGNETIC FLUX TO RELEASE THE CARRIED LOAD

BACKGROUND OF THE INVENTION

The present invention relates to a magnetic device with retaining strength to move, affix or carry ferromagnetic parts or loads provided with electronic switching of the magnetic flux to release the carried load.

The moving or carrying of ferromagnetic parts or loads is basically achieved by two means: (a) devices known as permanent load magnets, operated manually or electrically, wherein magnetic attraction is created by moving their cores with consequent change in the orientation of the magnetic flux lines; and (b) electromagnets, wherein artificial magnetic attraction is created by an electric current flowing through a coil. By causing variations in some factors, such as dimensions and current intensity, the electromagnet is capable of lifting and moving ferromagnetic objects ranging from thin blades up to articles weighing tons. Problems, however, are posed by both of the aforementioned devices. In permanent load magnets, lack of safety is an ever-present condition, due to high dispersion of the magnetic flux, and operation is sluggish, requiring external sources of energy (motor) when the weight to be carried it very high, since the magnet's power of attraction is closely related to its own size. In the case of electromagnets, if some external agent causes even an instantaneous lack of electric power, they lose their power of attraction and the ferromagnetic load being carried will drop away. Additionally, the consumption of power for maintaining the attraction is very high.

SUMMARY OF THE INVENTION

It is an object of the present invention to provide a practical permanent magnetic device that is safe and economical in operation and which is not dependent on the creation of artificial characteristics of attraction to sustain and retain ferromagnetic loads.

Another object of the present invention is to provide a permanent magnetic device by which a load being carried thereby can be released by electronic switching.

Briefly, in accordance with the invention, these and other objects are attained by providing a device comprising a central iron core enclosed by a pair of affixed iron magnets, laterally joined to reinforcing plates and terminated by lateral poles, with a coil being disposed on said central core and, above the former, a sliding cover moving on a pair of guide pins surrounded by springs, said cover being centrally provided with a lifter eyelet and an electronic control circuit incorporated externally in one of the side walls of a rectangular enveloping overcover.

DESCRIPTION OF THE DRAWINGS

For a better understanding of the subject invention, the same shall now be described with reference to a preferred embodiment illustrated in the accompanying drawings, wherein:

FIG. 17, 17*a* and 17*b* are schematic illustrations of examples of coil selection and/or switching in a two-pole device in accordance with the invention;

FIG. 18, 18*a* and 18*b* are schematic illustrations of examples of coil selection and/or switching in a three-pole device in accordance with the invention;

FIG. 20 is a comparative table illustrating relationships between number of poles, permanent magnet blocks, coils and maximum breaking weight, of various possible configurations of devices in accordance with the invention.

DETAILED DESCRIPTION OF THE PREFERRED EMBODIMENTS

Figure 1:
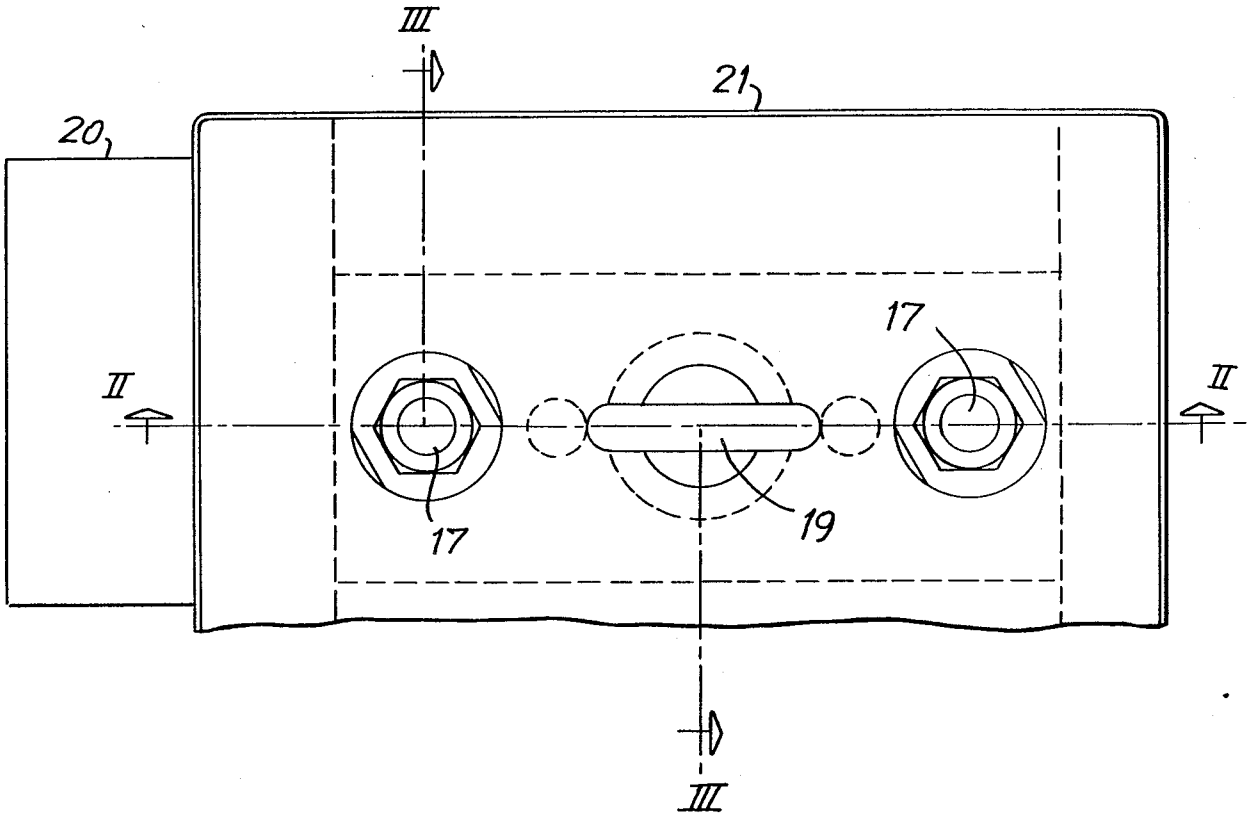
FIG. 1 is a top view of a device in accordance with the invention.
Figure 2:
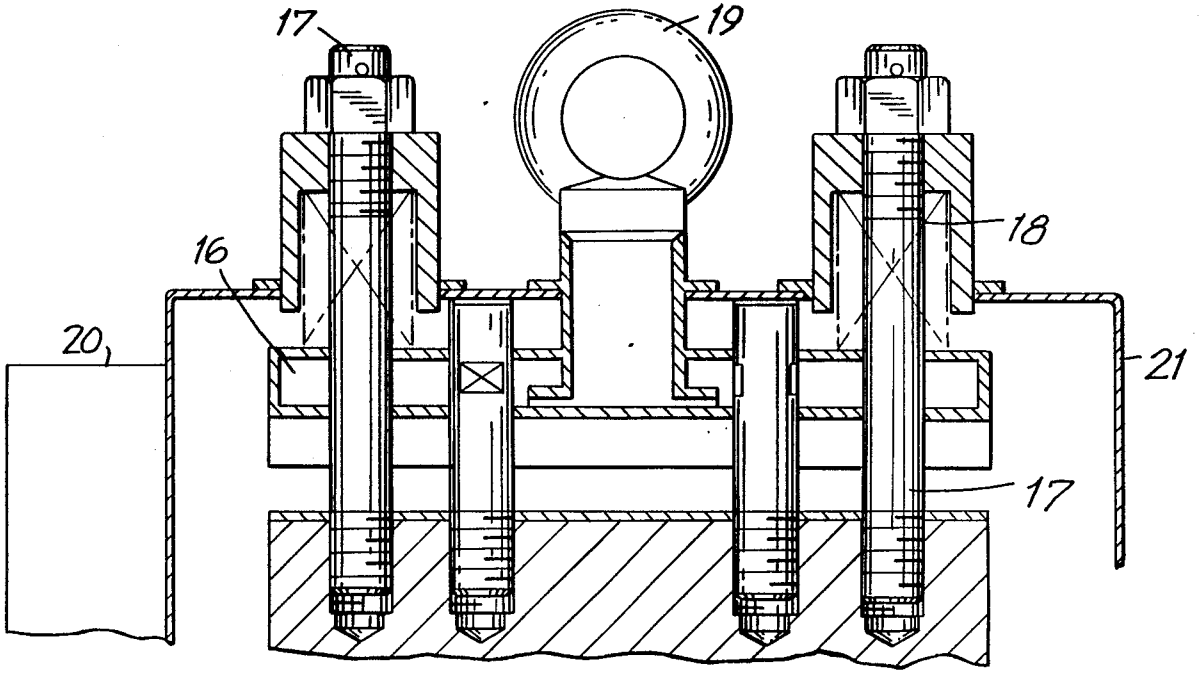
FIG. 2 is a section view taken along line II—II of FIG. 1.
Figure 3:
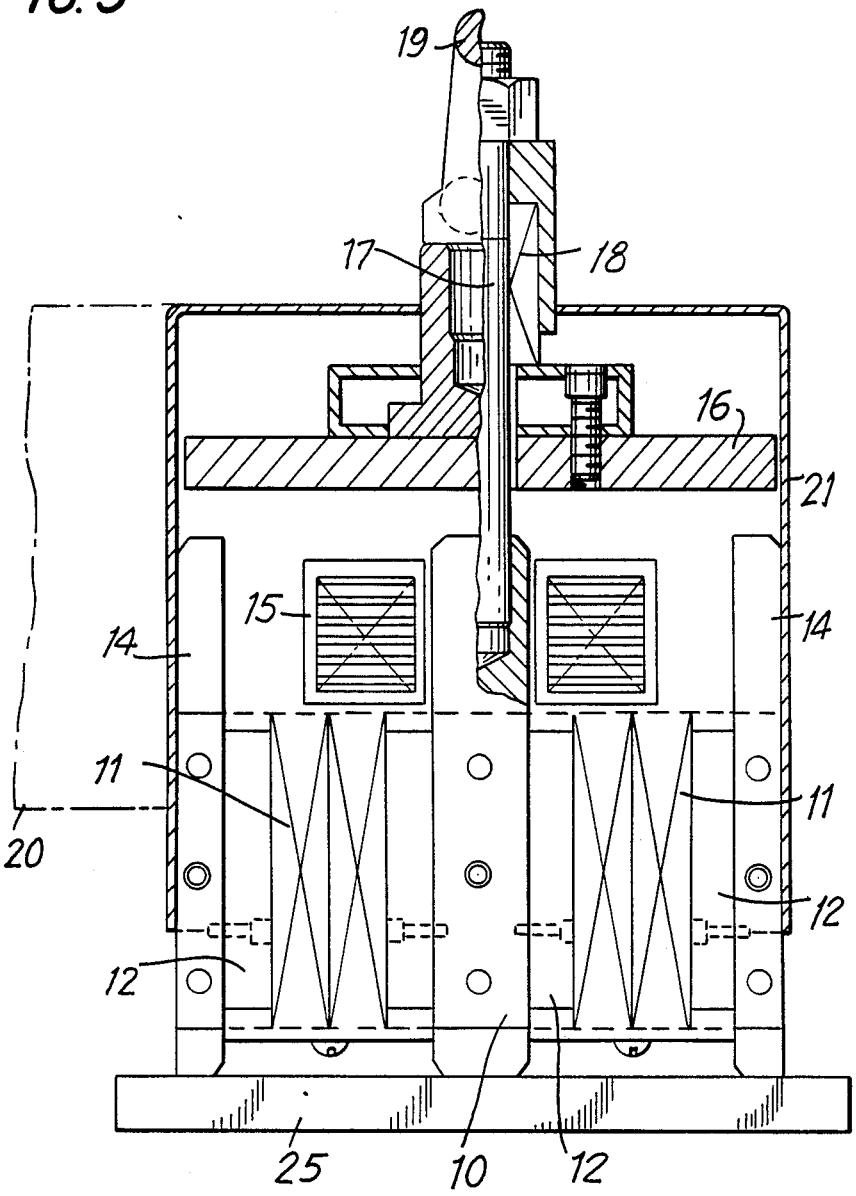
FIG. 3 is a section view taken along line III—III of FIG. 1.
Figure 4:
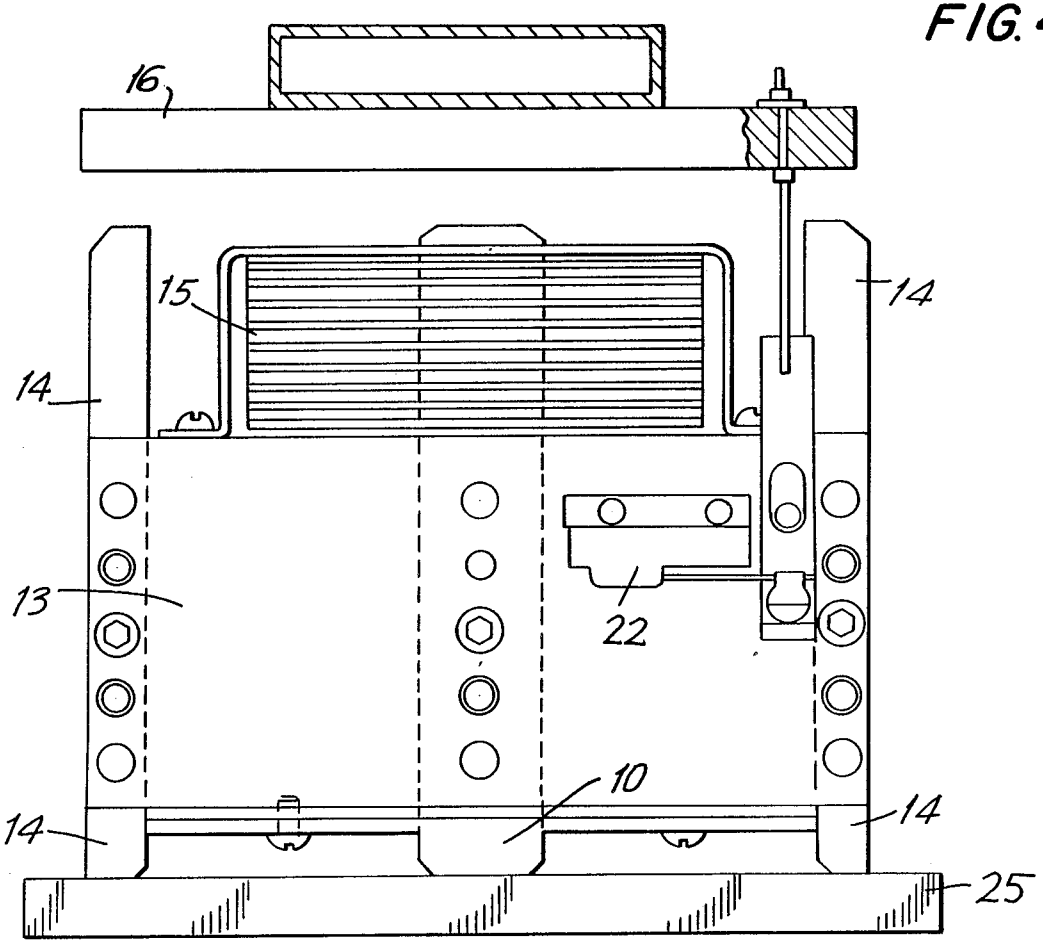
FIG. 4 is a side elevation view of the device illustrated in FIG. 1.
Figure 5:
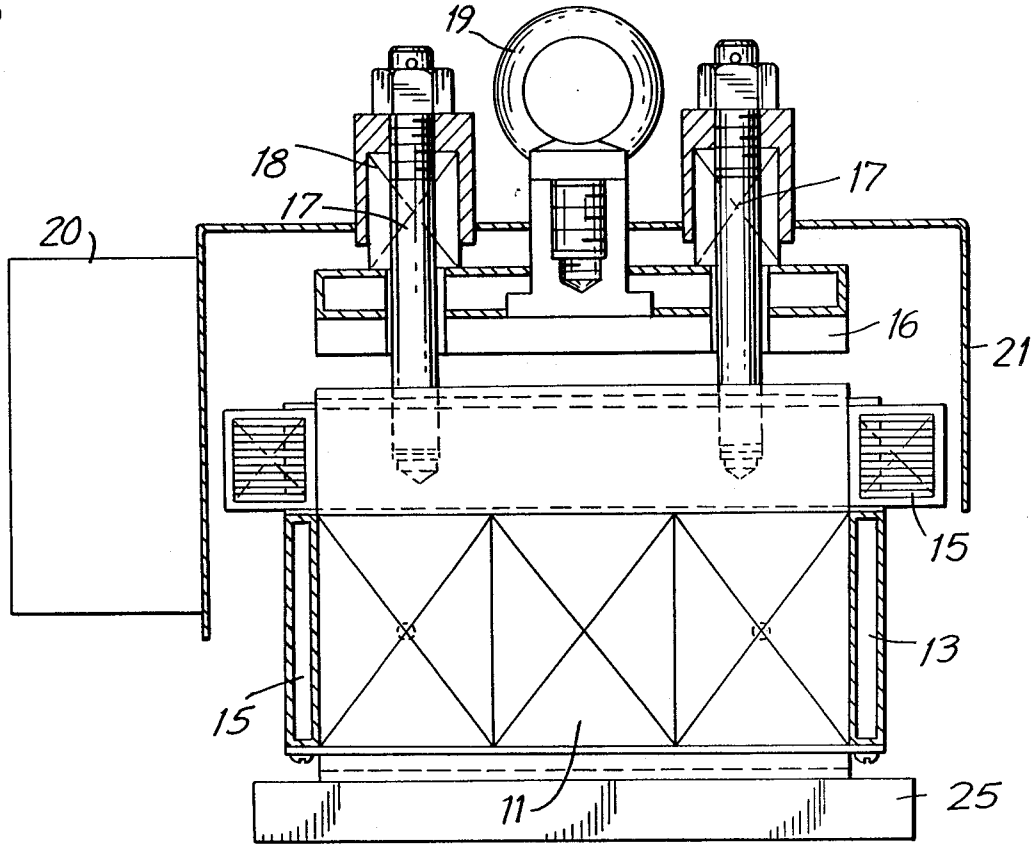
FIG. 5 is a view similar to FIG. 2, illustrating the lower portion of the device.
Figure 6:
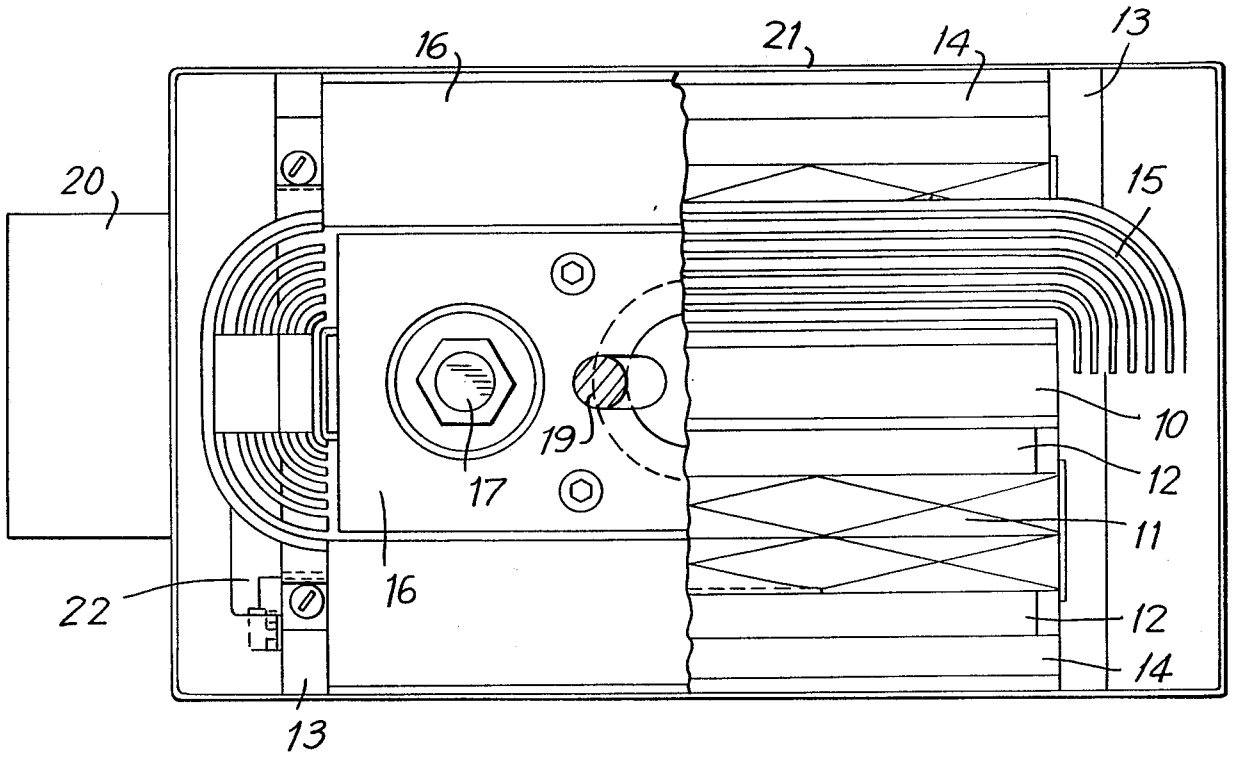
FIG. 6 is a top half-view and half-cross-sectional view of the device shown in FIG. 1.
Figure 7:
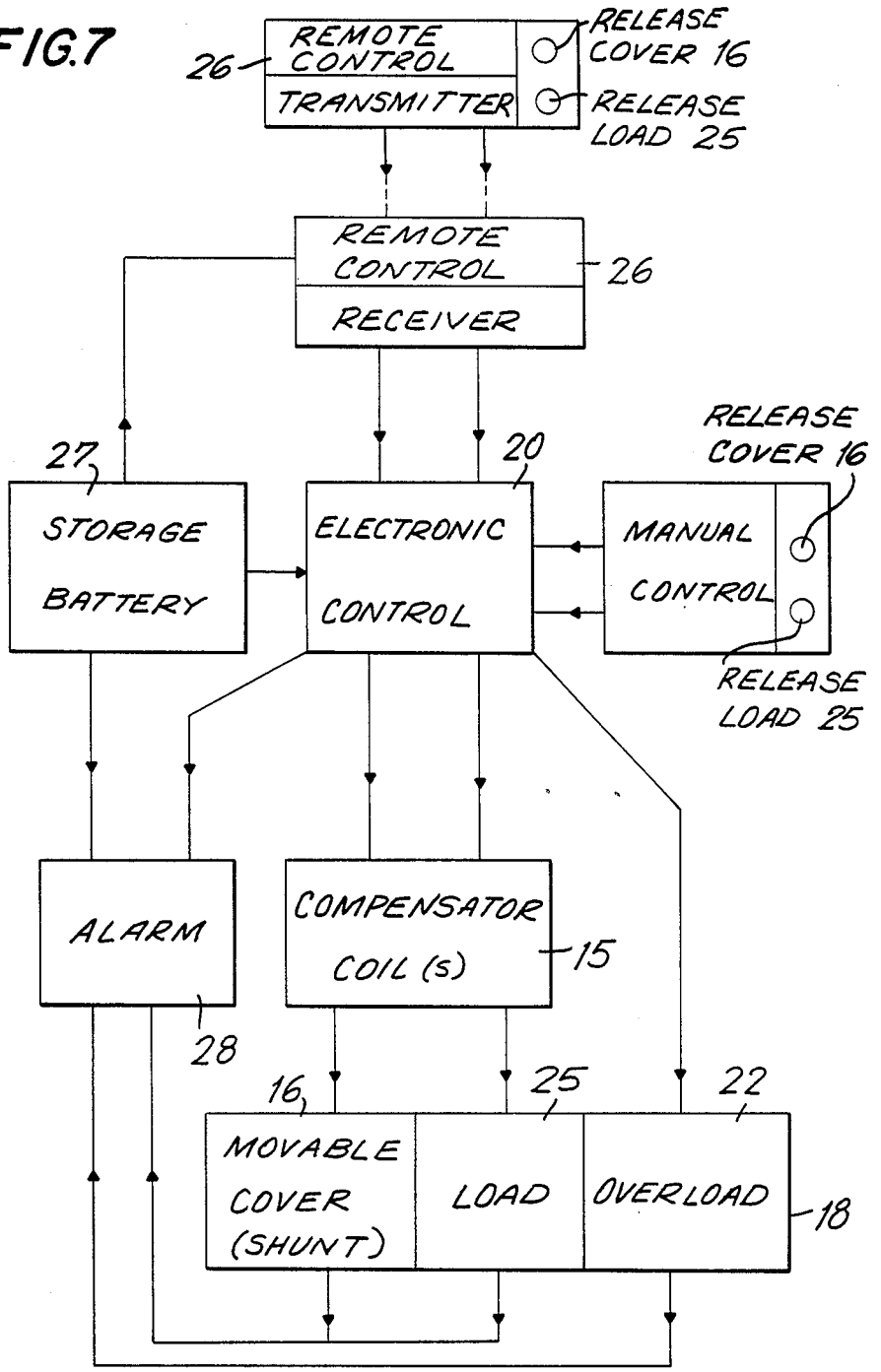
FIG. 7 illustrates the operation of a permanent magnetic device in accordance with the invention in the form of a block diagram.

Referring now to the drawings wherein like reference characters designate identical or corresponding parts throughout the several views, a permanent magnetic device in accordance with the invention with retaining strength to move, affix or carry ferromagnetic parts or loads provided with electronic switching of the magnetic flux to release the carried or affixed load includes a central iron core (10) enclosed by a pair of magnet blocks (11) secured by iron shoes (12), laterally joined to reinforcing plates (13) and terminated by lateral poles (14), with a compensator coil (15) being disposed on said central core (10) and with a sliding cover (16) above the former, moving on a pair of guide pins (17) and surrounded by mechanical force gauges (18), said cover (16) being centrally provided with a lifter eyelet (19). An electronic control circuit (20) is incorporated externally in one of the side walls of a rectangular enveloping overcover (21) wherein, at the opposite side thereof, a sensor (22) of the electronic circuit (20) is incorporated.

To properly explain the operation of the device, it will be understood that the indications N and S in the drawings designate north and south magnetic poles respectively, that the indications (+) and (−) designate the positive and negative poles of an electric current respectfully, and that the static magnetic-flux lines (23) and dynamic magnetic-flux lines (electromagnetic flux)

(24), and the standard direction from north pole to south pole have been adopted. Therefore, whenever the cover (16) is in its closed position, the permanent magnetic flux is divided into two parts, thus facilitating switching and compensation of the magnetic flux through the electromagnetic coil (15) compensating the permanent magnetic flux present in the central core (10) of the magnets (11) and lateral poles (14).

Figure 15:
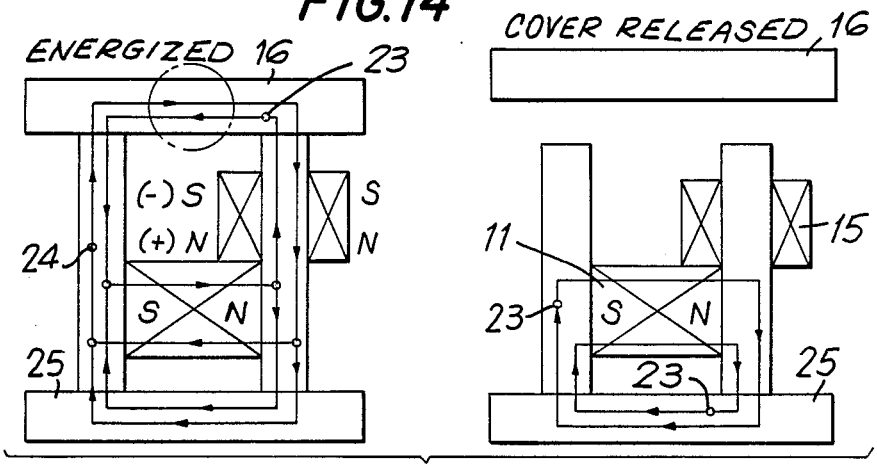
FIG. 15 and 16 illustrate, respectively, the flux compensation to release the cover and or load being carried.
Figure 16:
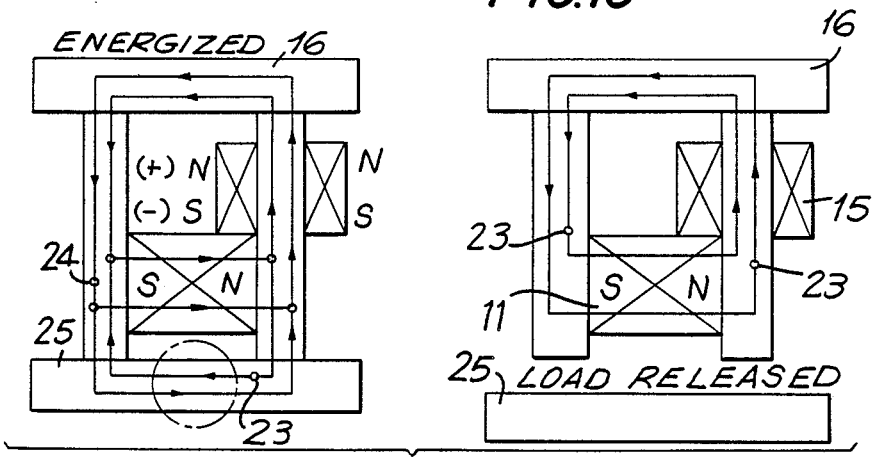
Figure 19:
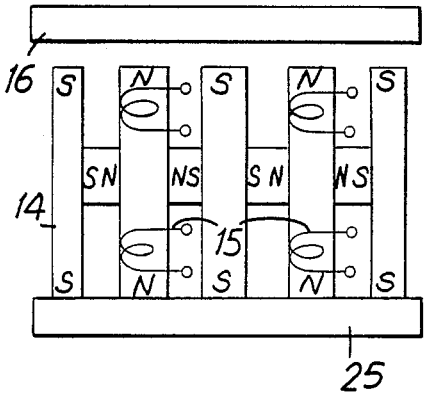
FIGS. 19, 19*a*, 19*b*, 19*c* and 19*d* are schematic illustrations of examples of coil selection and/or switching in a five-pole device in accordance with the invention.
Figure 19A:
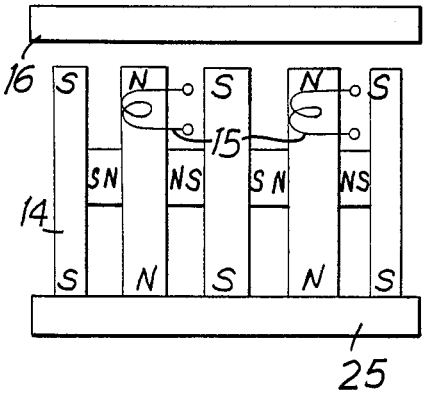
Figure 19B:
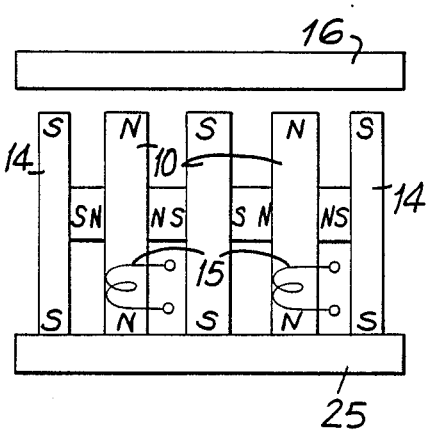
Figure 19C:
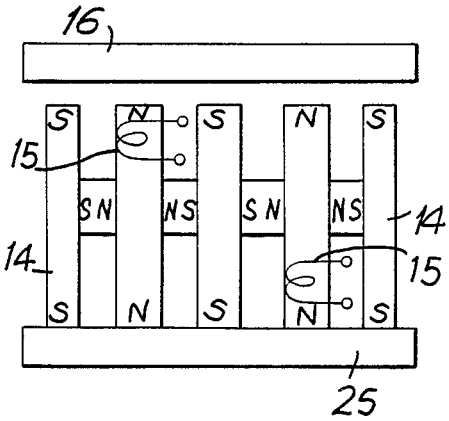
Figure 19D:
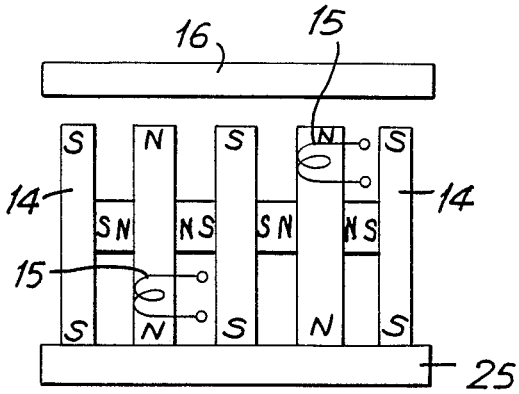

Depending on the polarity of the flux from the electromagnetic coil (15), the permanent magnetic flux can be compensated from the load (25) side, as illustrated in FIG. 16, thus releasing the load (25). By changing this polarity, as illustrated in FIG. 15, the permanent magnetic flux can be compensated, thus releasing the cover (16) and forcing all the flux to the load (25) side in order to ensure high retaining strength on the side of the load to be moved.

Measurement and control of the maximum permissible load are achieved by mechanical force gauges (18) which may be concentrator or dish expansion springs, elastic rings, magnetrostrictive, resistive, inductive or capacitive means, or other means that transmit to the sensor (22), which can operate on the basis of electrical contacts; end-of-travel switches, microswitches, reed switches, resistive, capacitive, inductive sensors or other suitable means. The electronic control circuit (20) can be operated manually or by remote control (26), from a distance, operating preferably with a storage battery (27), being independent from the electric network and operating optionally by means of the latter. This circuit is provided with an alarm (28) to indicate overload or overweight and also power shortage in the battery (27), which can be carried out by a sensor, such as a zener diode that triggers an alarm when the voltage of battery (27) reaches a preestablished minimum, indicating the need for recharging or replacement of the battery (27).

The remote control can operate on any one of the following principles:

(a) radio frequency encoded by pulse width difference or any other means, for more than two channels;

(b) visible light or invisible light, such as infrared, laser or other, for more than two channels; and (c) sound or ultrasound, for more than two channels.

The operating rate thereof is in accordance with two arrangements:

(a) n magnetic units with command boxes and receivers and n transmitters, each working independently and simultaneously within a three hundred-meter maximum radius of action and;

(b) n magnetic units and command boxes working with a corresponding transmitter simultaneously and dependent on a three-hundred-meter maximum radius of action.

In the foregoing, n is a whole number greater than or equal to one.

The remote control (26) operated by radio frequency (or RF), also known as microwaves, would indicate a 300-MHz frequency and would comprise a portable pocket-sized transmitting unit and receiver incorporated in the device's electronic control (20). The transmitting unit issues ten encoded pulses with a duration of 0.5 ms or 0.1 ms each. After ten pulses, there is an interval of 10 ms. to synchronize the receiving and transmitting units. From the pulse width, a secret or key is created that causes the receiving unit to accept only two codes as correct, or the transmitter can have up to two distinct codes, since it is also provided with two distinct commands, namely: release the cover (16)/release the load (25). The receiving unit is provided with a circuit of a superregenerative type which, upon receiving the signal from the transmitter, sends this signal to the decoding circuit, which either accepts or rejects the operating command.

Figure 8:
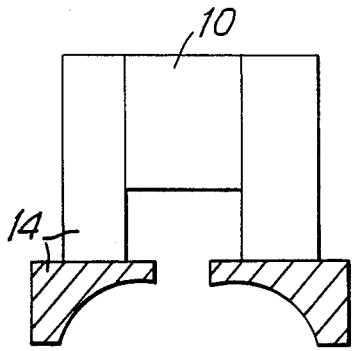
FIGS. 8 to 10 illustrate various shapes of poles for use in a permanent magnetic device in accordance with the invention.
Figure 9:
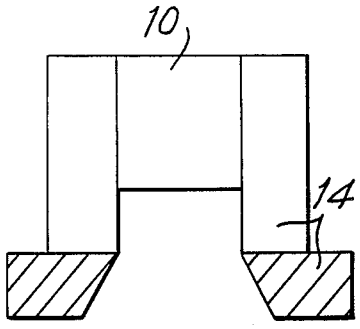
Figure 10:
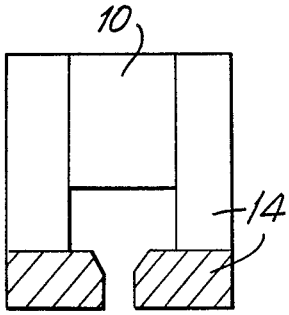
Figure 10A:
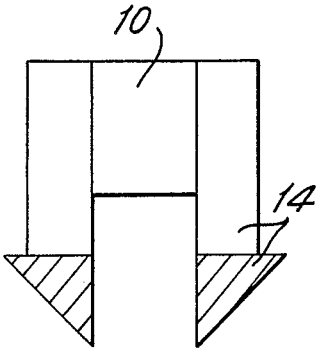

Various configurations of poles (14) can be adapted to the permanent magnetic device, such as are shown in FIGS. 8 to 10, to carry or move loads (25), such as coils, pipes, light and heavy loads, high-temperature parts, and the like.

Figure 11:
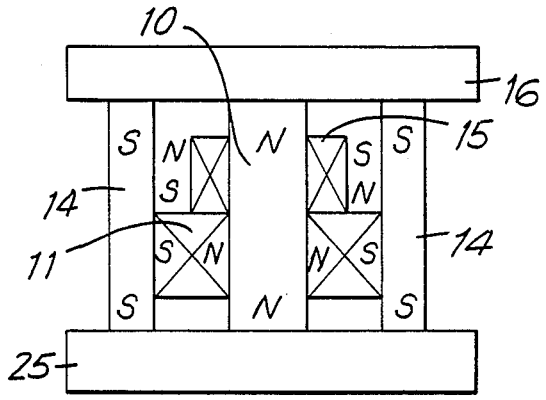
FIGS. 11 to 12 illustrate batteries for use in permanent magnetic circuits or compensator coils in accordance with the invention.
Figure 12:
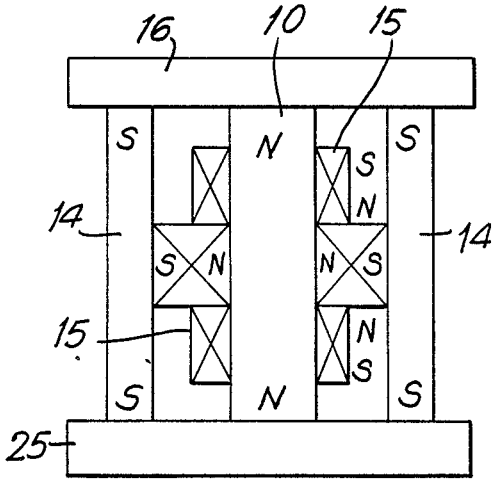
Figure 13:
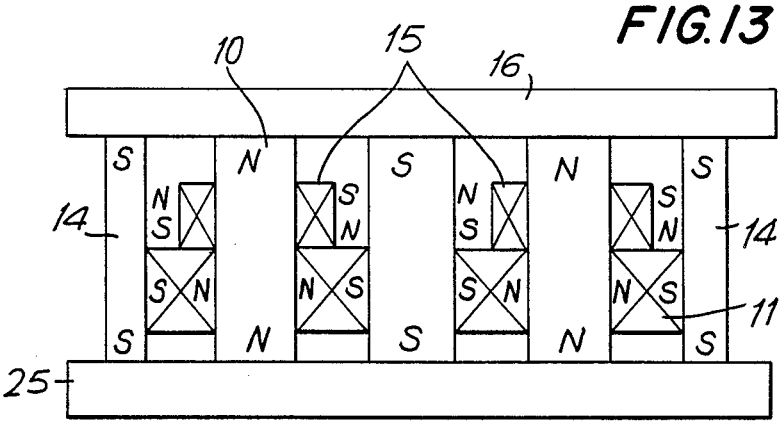
Figure 14:
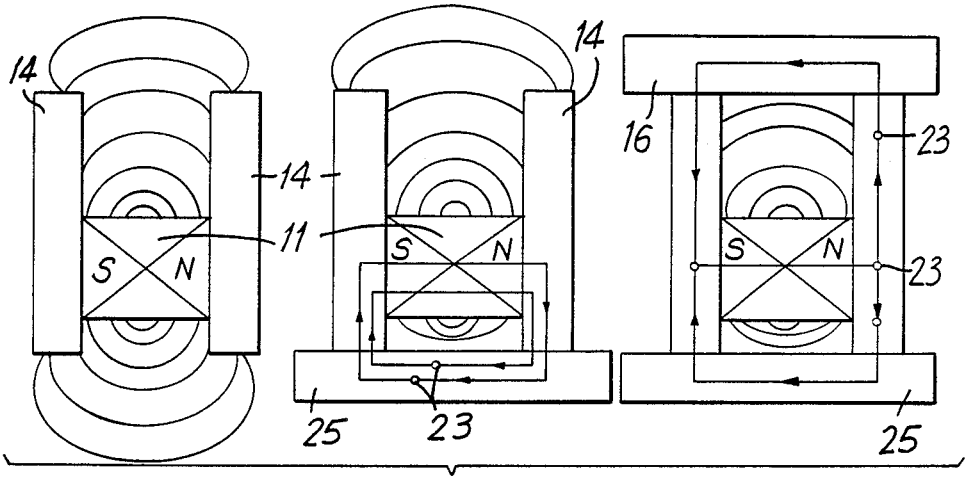
FIG. 14 illustrates the working principle of the magnetic fluxes in a two-pole permanent magnetic device in accordance with the invention.

FIGS. 11 to 13 illustrate possible configurations applied to such a device, incorporating, as the need may be, batteries of permanent magnetic core circuits (10), magnet blocks (11) and lateral poles (14) or compensator coils (15).

In this manner, ferromagnetic parts or loads can be moved or carried, this being done in an extremely safe manner, due to the presence of sensor means, alarms, and the device's inherent configuration, and absence of an external power supply to sustain the carried load.

The permanent magnets used in this device have high coercive force and can be divided into three groups, namely:

Group 1: Isotropic and Anisotropic Ferrites, either from Barium, Strontium or Lead;

Group 2: Magnetic alloys known commercially as "Alnico", "Alcomax", "Ticonal", etc. This group covers those compounded with Cobalt, Niobium, Copper, Aluminum and Steel;

Group 3: Rare-earth, that is, Samarium Cobalt or Cerium Cobalt.

To summarize, the present invention is directed to a multi polar device with (N) poles 14, (N-2) central iron cores 10 enclosed by (N-1) magnetic blocks 11 secured by iron shoes 12 laterally joined to reinforcing plates 13 and terminated by two of said lateral poles 14. Upon the (N-1) central cores 10, at least one of (N-1) selecting compensator coils 15 and (N-1)/2 reversing compensator cores 15 are placed. At least one sliding cover 16 is placed above the (N) poles 14, moving on guide pins 17 and surrounded by mechanical force gauges 18. These covers 16 are centrally provided with at least one lifter eyelet 19. An electronic control circuit 20 is incorporated externally in one of the side walls of a rectangular enveloping cover 21 in which, at the opposite side thereof, sensors 22 of the electronic circuit 20 are incorporated (N denotes a whole number greater than or equal to one).

Furthermore, the electronic control circuit 20 may be operated by remote control 26 comprising at least two transmission and/or may be channels operated manually by push buttons or connected by transmission wires and provided with an overload warning alarm by means of the force gauges 18 that operate electric or electronic sensors 22 in the electronic control system 20.

Clearly, numerous modifications and variations of the present invention are possible in the light of the above teaching. It is therefore to be understood that the invention may be practiced otherwise than as specifically disclosed herein.

What is claimed is:

1. A permanent magnet retaining device to move, affix or carry ferromagnetic parts or loads comprising:

a central iron core;

a pair of magnet blocks enclosing said central iron core;

a plurality of iron shoes connected to said magnet blocks and functioning to secure said magnet blocks;

a plurality of reinforcing plates connected to said magnet blocks;

two lateral poles connected respectively to said pair of magnet blocks and spaced away from said central iron core;

a sliding cover situated above both of said poles and having a lifter eyelet;

a pair of guide pins on which said sliding cover moves;

a plurality of mechanical force gauges respectively located adjacent to said guide pins;

an overcover surrounding said two lateral poles;

an electronic control circuit situated in a side wall of said overcover;

a sensor located remotely from said electronic control circuit, said sensor functioning to receive information from said plurality of mechanical force gauges and functioning to transmit information to said electronic control circuit; and at least one compensator coil, one of said at least one compensator coils being situated on top of one of said two lateral poles.

2. The permanent magnet retaining device of claim 1, wherein said device is a multipolar device, with (N) of said poles, (N-2) of central iron cores enclosed by (N-1) of said magnetic blocks secured by said iron shoes laterally joined to said reinforcing plates and terminated by two of said lateral poles, upon said (N-1) of said central cores being placed at least one of (N-1) of said compensator coils which are selecting, and (N-1)/2 of reversing compensator cores and comprising a plurality of sliding covers, with there being at least one of said sliding covers above the (N) poles, moving on said guide pins, surrounded by said mechanical force gauges, said covers being centrally provided with at least one lifter eyelet, and said electronic control circuit incorporated externally in said side wall of said rectangular enveloping overcover wherein, at the opposite side thereof, a plurality of sensors of said electronic circuit are incorporated.

3. The permanent magnet retaining devices of claim 1, wherein said electronic control circuit comprises remote control transmission means comprising at least two wireless transmission channels and provided with an overload warning alarm by means of said force gauges that operated a plurality of sensors which are electric or electronic in the electronic control system.

4. The permanent magnet retaining device of claim 1, wherein said at least one permanent magnet and compensator coil are arranged such that permanent magnetic flux can be directed from a side of a load, thus releasing the load, or the permanent magnetic flux can be directed by changing polarity to release the sliding cover and force all flux to the load, thereby ensuring high retaining strength of the load.

5. The permanent magnet retaining device of claim 1, wherein one of said at least compensator coils is situated on top of said central iron core.

* * * * *